US009222323B2

(12) United States Patent
Skjeie

(10) Patent No.: US 9,222,323 B2
(45) Date of Patent: Dec. 29, 2015

(54) PETROLEUM WELL DRILL—OR COILED TUBING STRING MOUNTED FISHING TOOL

(71) Applicant: Archer Oil Tools AS, Stavanger (NO)

(72) Inventor: Trond Skjeie, Hundvåg (NO)

(73) Assignee: Archer Oil Tools AS, Stavanger (NO)

( * ) Notice: Subject to any disclaimer, the term of this patent is extended or adjusted under 35 U.S.C. 154(b) by 15 days.

(21) Appl. No.: 14/233,357

(22) PCT Filed: Jan. 14, 2013

(86) PCT No.: PCT/NO2013/050009

§ 371 (c)(1),
(2) Date: Jan. 16, 2014

(87) PCT Pub. No.: WO2014/109643

PCT Pub. Date: Jul. 17, 2014

(65) Prior Publication Data

US 2015/0211316 A1 Jul. 30, 2015

(51) Int. Cl.

| | |
|---|---|
| ***E21B 37/00*** | (2006.01) |
| ***E21B 31/06*** | (2006.01) |
| ***E21B 27/04*** | (2006.01) |

(Continued)

(52) U.S. Cl.

CPC ..... *E21B 31/06* (2013.01); *E21B 27/04* (2013.01); *E21B 34/14* (2013.01); *E21B 37/00* (2013.01); *E21B 2034/007* (2013.01)

(58) Field of Classification Search

CPC ..... E21B 37/00; E21B 34/14; E21B 31/06; E21B 2034/007

See application file for complete search history.

(56) References Cited

U.S. PATENT DOCUMENTS

| | | | | |
|---|---|---|---|---|
| 3,203,491 | A | 8/1965 | Turley | |
| 4,059,155 | A | 11/1977 | Greer | |
| 4,540,055 | A * | 9/1985 | Drummond et al. | 175/323 |

(Continued)

FOREIGN PATENT DOCUMENTS

WO WO 2005/124098 A2 12/2005

*Primary Examiner* — Jennifer H Gay
*Assistant Examiner* — Steven MacDonald
(74) *Attorney, Agent, or Firm* — Birch, Stewart, Kolasch & Birch, LLP

(57) ABSTRACT

A petroleum well drill- or coiled tubing string mounted fishing tool includes a main body including a lower housing with a magnet having at least one magnet surface facing downwards in the well at a lower end of the lower housing and arranged for catching and holding undesired magnetic objects present in the well, the main body provided with a connector to the drill- or coiled tubing string at its upper end. The tool further includes a generally cylindrical upper housing with a central channel with laterally directed curl flow forming nozzles through the cylindrical wall of the upper housing, the nozzles leading out into one or more helical grooves between helical ridges, the magnet including permanent magnets arranged in a magnetization pattern which concentrates their combined magnetic flux through the downwards facing surface, the upper housing's vertical channel extending near its lower end to peripherally directed channels extending to an outer wall of the lower housing about the magnets and leading to axially directed peripheral nose ports at a peripheral lower end of the lower housing and arranged for flushing fluid ahead of the magnet, the central channel provided with a vertically displaceable cylindrical flow control sleeve which is provided with a closing seat near its lower end so as for receiving a ball for shutting off the flow to the nose ports and redirecting the flow through apertures in the wall of the sleeve to the curl flow forming nozzles.

16 Claims, 8 Drawing Sheets

(51) Int. Cl.
*E21B 34/14* (2006.01)
*E21B 34/00* (2006.01)

(56) References Cited

U.S. PATENT DOCUMENTS 5,224,548 A 7/1993 Dankovich, II
5,533,571 A * 7/1996 Surjaatmadja et al. ..... 166/222
6,308,783 B2 * 10/2001 Pringle et al. ..... 166/320
2006/0219441 A1 * 10/2006 Telfer ..... 175/325.7
2007/0017679 A1 * 1/2007 Wolf et al. ..... 166/312
2011/0285155 A1 11/2011 Nelson et al.
2012/0261114 A1 * 10/2012 Shoyhetman et al. ..... 166/99
2013/0000884 A1 1/2013 Linklater
2013/0043752 A1 * 2/2013 Sankar ..... 310/152

* cited by examiner

L1, L2, L3 = curl flow radial bore levels
E (Fig. 9)
A (Fig. 5)
C (Fig. 7)
B (Fig. 6)
D (Fig. 8)
L1
L2
L3
ball
41
4
83g
84c
6c
7b
6b
84b
84a
6a
curl flow before displacement
84-L
8 in upper position,
21
22
2a
83
7bw
71
7a
2b
5a to 5b
5b
3, 31, 32, 33, 34
nose flow before displacement
3f
curl forming flow after displacement
82, 81
81
8 in lower position Fig. 5: section across A-A of Fig. 2, looking upwards.

Fig. 6: section across B-B of Fig. 2, looking upwards.

Fig. 7: section across C-C of Fig. 2, looking upwards.

Fig. 8: section across D-D of Fig. 3, looking upwards.

Fig. 9: section across E-E of Fig. 2, looking upwards.

PETROLEUM WELL DRILL—OR COILED TUBING STRING MOUNTED FISHING TOOL

INTRODUCTION

The present invention is in the field of down hole so-called fishing equipment used in most on/offshore oil and gas wells. More particularly, the invention relates to removing magnetic objects and accumulated magnetic debris as well as other particles from the wellbore rapidly and efficiently. The device of the invention is normally run on a drill string.

Problems Related to Background Art

During well operations such as drilling or running tools into and out of the wellbore, debris, including magnetic debris, is generated, generally mechanically, by tasks preformed, due to ubiquitous minor collisions and friction between metal components or between metal components and rock. This debris can cause problems for down hole equipment and operations. It is vital to the operations that debris, both non-magnetic and magnetic, is removed before or during operations to prevent potentially hazardous consequences to people, the environment and well components. In an event of equipment failure, parts may break/twist of and leave undesired magnetic objects in a wellbore. Such lost objects are commonly broken-off cones from drill bits, balls from valves. The broken off parts may prevent access to valves, may prevent the operation of valves, may block passages, etc. and need to be removed before operations can resume. Unremoved undesired objects can prohibit further well construction and a new costly well will have to be drilled.

The applicant has a so-called Tornar grab magnet which is a combined curl flow forming tool receiving axial flow from a drill pipe string and redirects the flow laterally through curl flow forming nozzles having their mouths arranged in a circular pattern, said nozzles arranged between ridges of a tool of an outer diameter of about 165 mm. At the lower end of the tool is a magnet in a cylindrical sleeve with a permanent magnet. The magnet has a maximum magnetic holding capacity of 1000 kg when in full areal contact with a piece of steel to be fished. Please notice that clay or mud may prevent full areal contact, thus potentially significantly reducing the holding capacity of this prior art tool. The so-called Tornar nozzles set up a curl flow only in an annular space starting above the magnet and extending upwards along the upper housing and the drill pipe string, a significant layer of clay or mud may cover the steel object below this curl forming tool of the prior art to a degree that one may not obtain a good or sufficient magnetic holding force. There is also a risk of magnetic particles to accumulate about the exterior surface of the lower housing holding the magnetic cylinder, with the accumulated particles restricting upwards flow past the tool. It is desirable to have a cleaner object to catch and hold, and desirable to have higher holding capacity on the lower surface of the magnet.

BRIEF FIGURE CAPTIONS

FIG. 1 is a perspective view of the petroleum well drill- or coiled tubing string mounted fishing tool of the invention. The string is attached via a mandrel to the upper left end shown in FIG. 1, and is omitted from the drawing. As can be seen from FIGS. 3 and 4, the tool of the invention may have an upper box fitting to a lower pin of a drill string series of drill pipes. As used in this description, the terms "upper" and "lower" relates to the tool used in a vertical wellbore. In case of a deviated wellbore, "upper" is in the direction along the drill pipe string, and "lower" is in the direction towards the inner portion of the wellbore.

FIG. 2 is an elevation view of the same, showing a lower portion 2*a* with a magnet and an upper portion with a curl flow forming flushing unit with lateral nozzles in helical grooves between helical ridges peripherally arranged around a part of the upper portion 2*b*.

FIG. 3 is a vertical section of the same. A central channel receives flow from the drill- or coiled tubing string above. The central channel 4 is provided with a flow control sleeve 8 which initially is arranged in an upper position and held by shear pins. In this upper position the flow control sleeve allows a large proportion of the flow to go through channels vertically extending peripherally with their mouths axially directed just near the front of the magnet. A small proportion of the flow is also directed through lower nozzles to maintain a restricted curl flow. A ball has been dropped into the flow and is about to enter the flow control sleeve.

FIG. 4 is a vertical section similar to the one of FIG. 3. Here the ball has landed in a closing seat in the lower portion of the flow control sleeve 8 and the pressure forces the flow control sleeve to break its breaking pins and displace itself to its lower position shown. This shuts off the flow to the nose ports and redirects all the flow to the curl flow forming nozzles, now flushing much more efficiently in order to carry particles upwards with the return flow in the annulus about the drill string. This will also reduce the fluid shear force to possible magnetizable object caught by the magnet, so as for maintaining the fished object on the magnet.

FIG. 5 is a cross-section in level A-A of FIG. 2. Radial channels through the ridges 7*b* are plugged and redirected through a lateral face of the ridges 7*b* so as to form curl flow forming nozzles 6. The flow runs from the central channel, through the local aperture level of the flow control sleeve 8, here L3, and is flushed out through the curl flow forming nozzle in the face 7*bw* of ridge 7*b*. This is repeated azimuthally, here through four ridges 7*b*. The number of ridges may vary with the diameter of the tool.

FIGS. 5 and 6 are looking upwards towards the carrying string.

Figures 2, 3, 4:
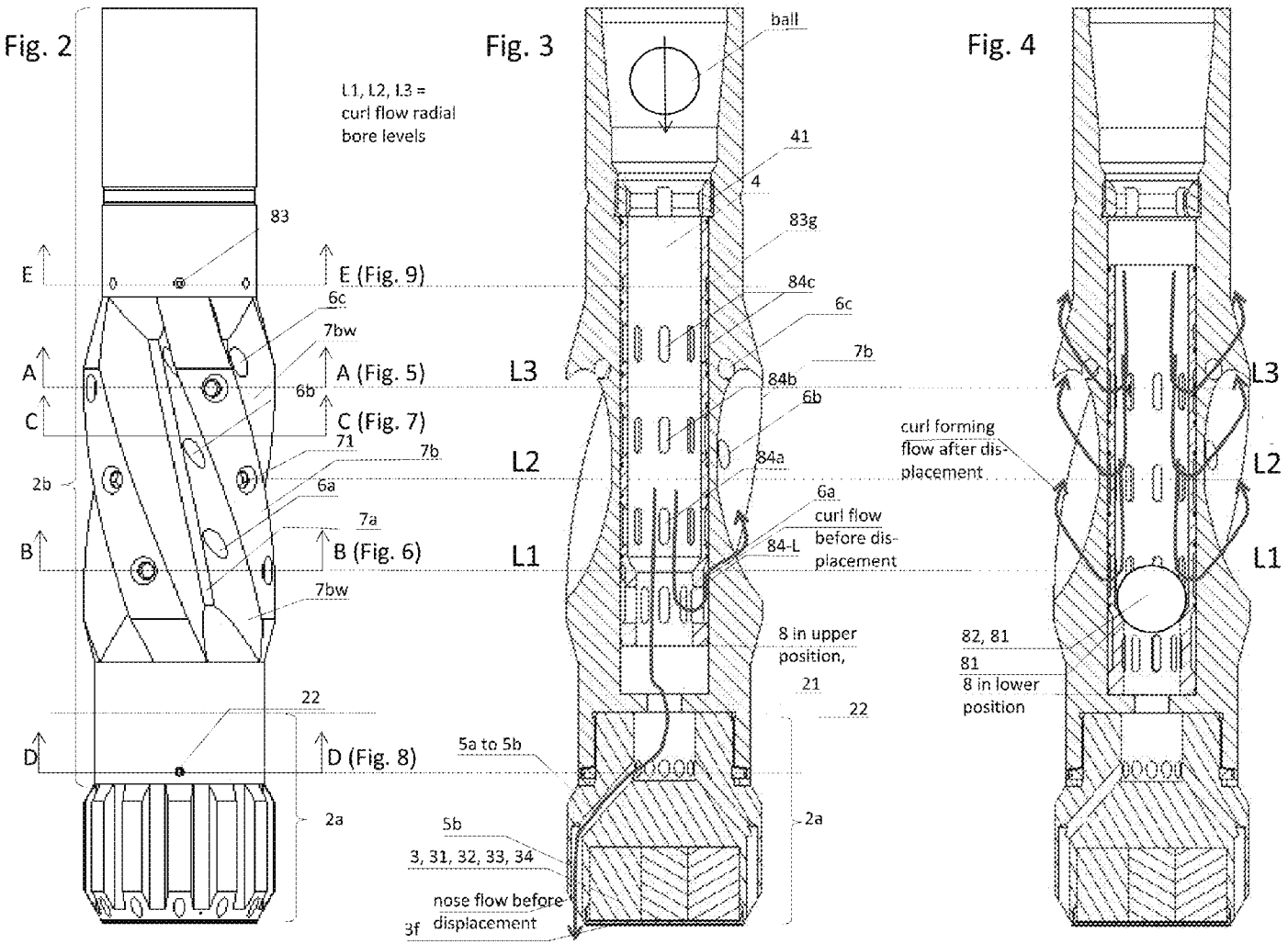
Figure 8:
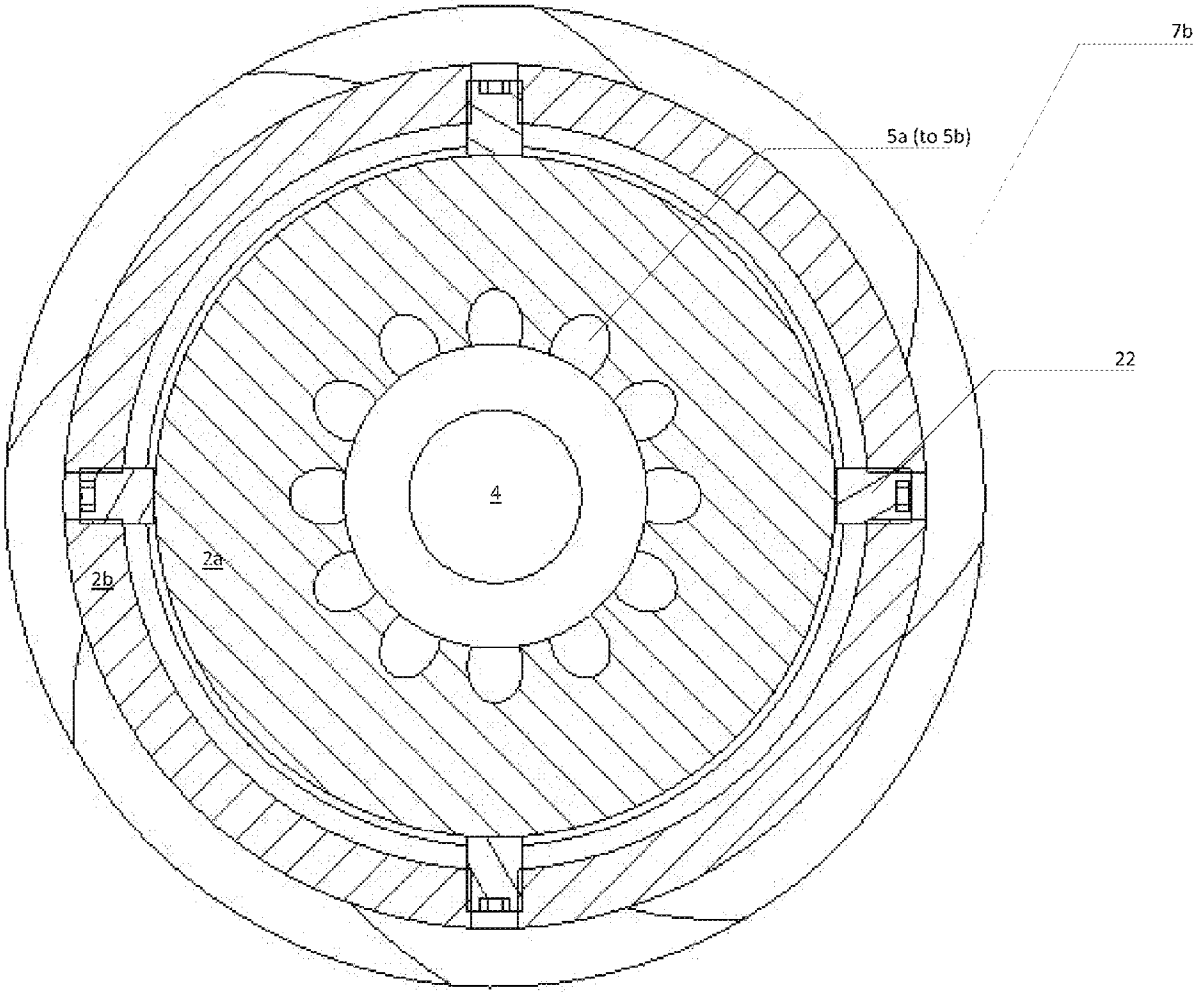

FIG. 8 is a cross-section through level D-D of FIG. 2, and is looking upwards. The central channel 4 is shown with its restriction for preventing flow control sleeve 8 to run all the way down into the lower portion, as well as the upper parts of the radial channels 5*a* extending aslant down from the central channel 4. Please notice a ring groove about the stem of the lower portion 2*a* which is locked in place by locking screws so as for allowing maintenance from below of the flow control sleeve 8, such as pushing it back after operation, and for allowing replacing the entire lower portion 2*a* in case the magnet or surrounding sleeve with nozzles 5 have been damaged. Peripherally in FIG. 8 one may see the toroidal ridges 7*b* above.

Figure 9:
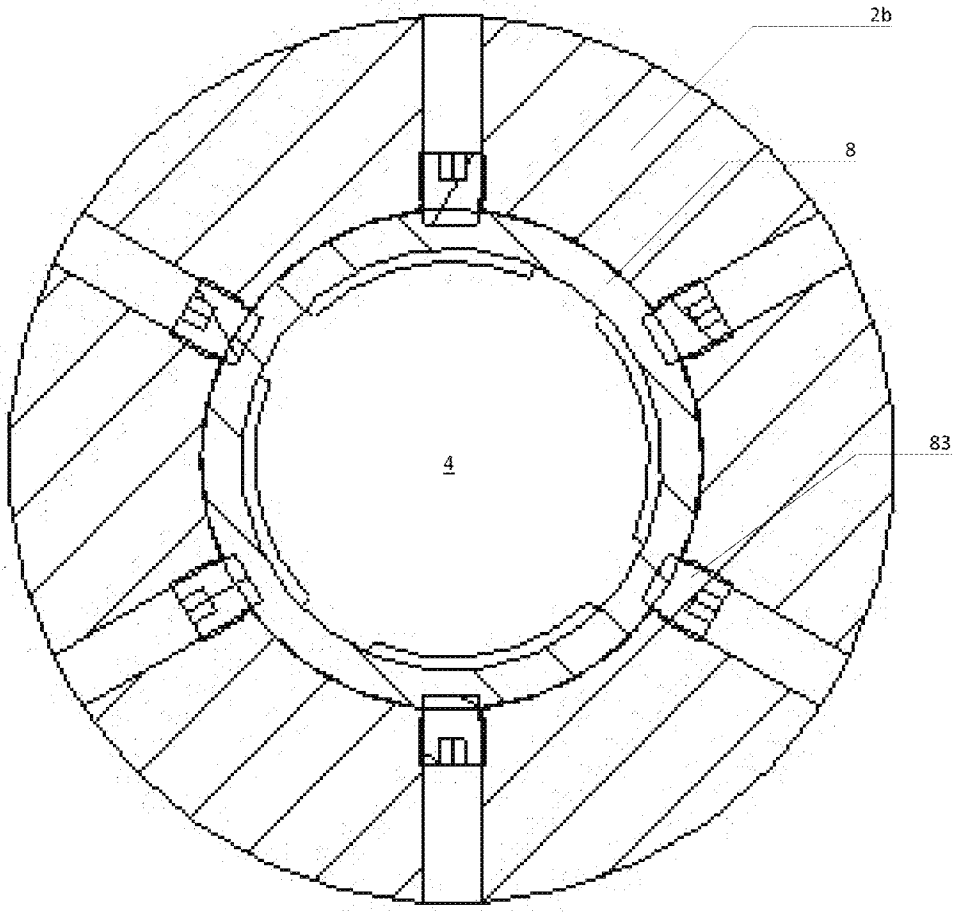

FIG. 9 is a cross-section through level E-E of FIG. 2, looking upwards. It shows locking pins holding a locking groove of the central flow control sleeve 8, please see FIGS. 3 and 4. The locking pins are screwed through threaded bores in from the peripheral surface of the upper housing 2*b*, please see FIG. 2.

Figure 10:
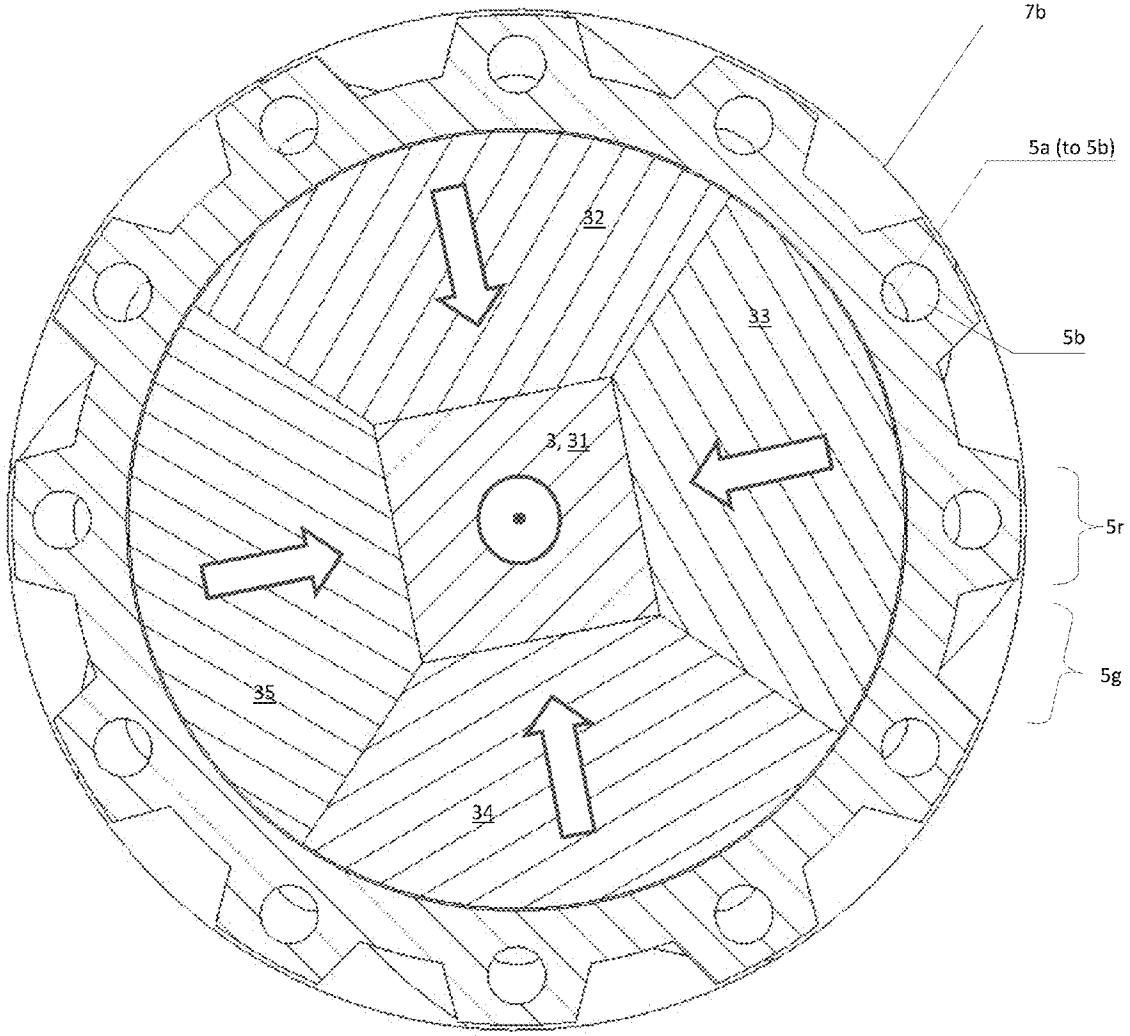

FIG. 10 is a cross-section and upward view of the lower portion (2*a*) and shows the array of the Halbach magnet 3 in its cylindrical sleeve with channeled ridges with the nose ports (5). Please notice that the periphery of ridges (7*b*) is continuous and extends outside the lower housing (2*a*), thus the tool may be rotated in the wellbore and the lower housing (2*a*) may generally be kept a minimum distance away from the wellbore wall except for protrusions or shoulders in the wellbore wall.

SUMMARY OF THE INVENTION

The invention is a petroleum well drill- or coiled tubing string (1, 1*b*) mounted fishing tool comprising a main body (2) comprising a lower housing (2*a*), preferably cylindrical sleeve, with a magnet (3) having at least one magnet surface (3*f*) facing downwards in said well at a lower end of said lower housing (2*a*) and arranged for catching and holding undesired magnetic objects present in said well, said main body (2) provided with a connector to said drill- or coiled tubing string (1, 1*b*) at its upper end, the fishing tool characterized by said main body (2) further comprising a generally cylindrical upper housing (2*b*) with a central [so-called vertical, preferably axial] channel (4) with laterally directed curl flow forming nozzles (6) through the cylindrical wall of said upper housing (2*b*), said nozzles (6) leading out into one or more helical grooves (7*a*) between helical ridges (7*b*), said magnet (3) comprising permanent magnets (31, 32, 33, 34, 35) arranged in a magnetization pattern which concentrates their combined magnetic flux through said downwards facing surface (3*f*), said upper housing's (2*b*) vertical channel (4) extending near its lower end to peripherally directed channels (5*a*) extending to an outer wall of said lower housing (2*a*) about said Halbach magnet (3) and leading to axially directed peripheral nose ports (5*b*) at a peripheral lower end of said lower housing (2*a*) and arranged for flushing fluid ahead of said magnet (3, 31, 32, 33, 34, 35), said central channel (4) provided with a vertically displaceable cylindrical flow control sleeve (8) which is provided with a closing seat (81) near its lower end so as for receiving a ball (82) for shutting off the flow to said nose ports (5*b*) and redirecting said flow through apertures (84, 84*a*, 84*b*, 84*c*) in the wall of said sleeve (8) to said nozzles (6).

Advantages of the Invention

By using the tool of the invention comprising a curl flow forming unit flow and a Halbach magnet the above mentioned situations can be resolved and operations can continue as planned.

The device is provided with the strong magnetic elements such as Neodym magnets. The Halbach magnet has a lifting capacity of about 1400 kg with full contact, compared to about 1000 kg of the prior art. One significant advantage of the Halbach magnet used in the present invention is the fact that long metallic objects such as steel bolts of length 200 mm and ϕ 20 mm will be magnetized in their long direction, and held on one end by the magnetic field directed generally axially and orthogonally out of the magnet, thus the bolt will extend axially and parallel with the tool of the invention. This will also to some degree prevent magnetic objects from attaching to the side surface of the lower housing. The curl flow foring ports create a powerful upwards directed cyclone effect around objects and the surrounding wellbore, ensuring full object contact with the magnet and good debris cleaning and extraction.

EMBODIMENTS OF THE INVENTION

Figure 1:
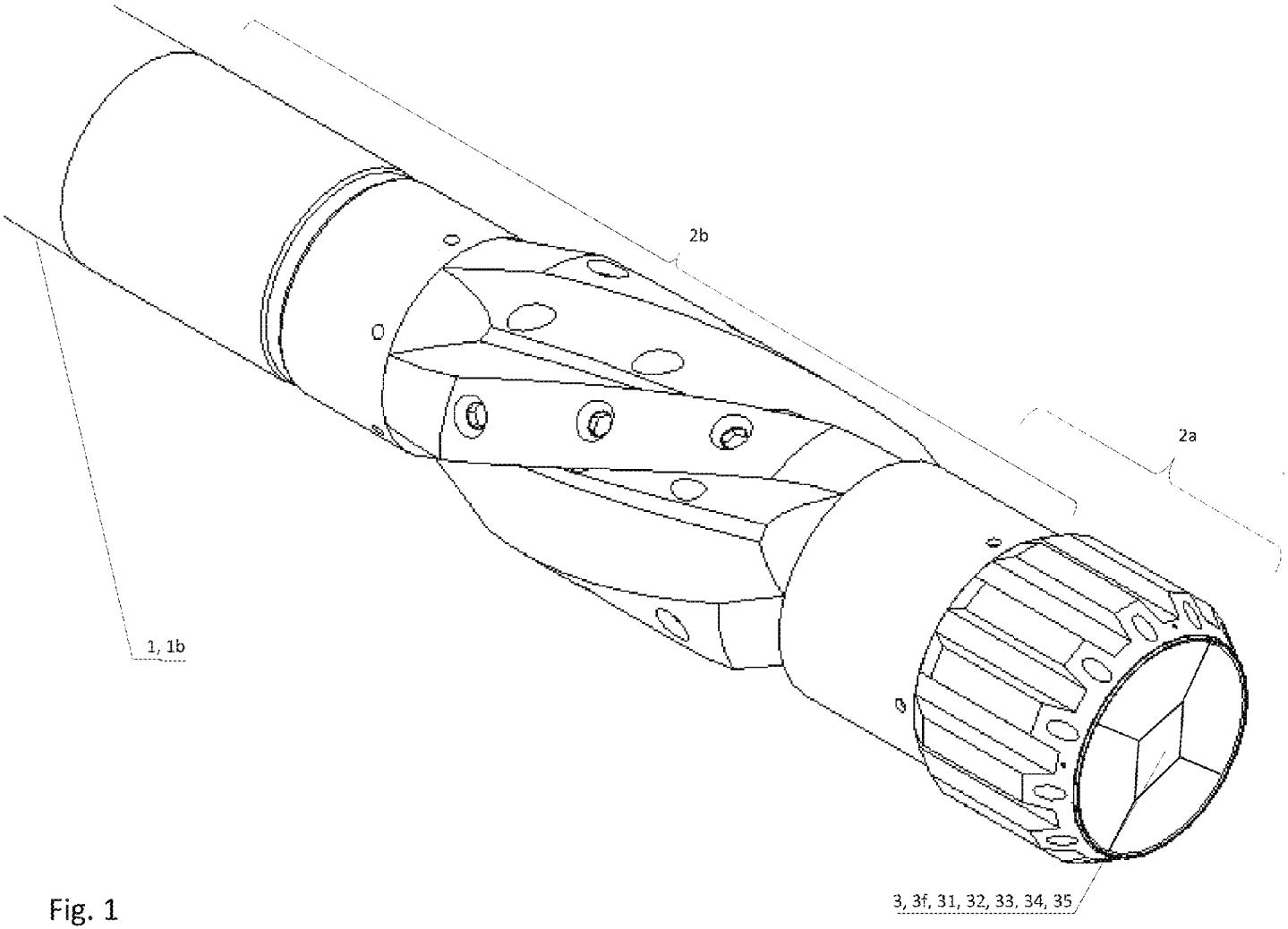

The invention is a petroleum well drill- or coiled tubing string (1, 1*b*) mounted fishing tool. The tool, which is illustrated in FIG. 1, and shown in elevation view in FIG. 2, comprises a main body (2) with a lower housing (2*a*), preferably a cylindrical sleeve, with a magnet (3) having at least one magnet surface (3*f*) facing downwards in said well at a lower end of said lower housing (2*a*) and arranged for catching and holding undesired magnetic objects present in said well. the main body (2) is provided with a connector to said drill- or coiled tubing string (1, 1*b*) at its upper end.

The main body (2) further comprises a generally cylindrical upper housing (2*b*) with a central, so-called vertical, preferably axial channel (4) with laterally directed so-called Tornar nozzles (6), i.e. curl flow forming nozzles (6), through the cylindrical wall of said upper housing (2*b*). The nozzles (6) are leading out into one or more helical grooves (7*a*) between helical ridges (7*b*).

The magnet (3) is advantageously comprising permanent magnets (31, 32, 33, 34, 35) arranged in a magnetization pattern which concentrates their combined magnetic flux through said downwards facing surface (3*f*). Preferably these permanent magnets constitute a so-called Halbach set of magnets.

The upper housing's (2*b*) vertical channel (4) extends near its lower end to peripherally directed channels (5*a*) extending to an outer wall of said lower housing (2*a*) about said set of magnets (3, 31, 32, 33, 34, 35) and leading to axially directed peripheral nose ports (5*b*) at a peripheral lower end of said lower housing (2*a*) and arranged for flushing fluid ahead of said set of magnets (3).

The central channel (4) is provided with a vertically displaceable cylindrical flow control sleeve (8) which is provided with a closing seat (81) near its lower end so as for receiving a ball (82) for shutting off the flow to said nose ports (5*b*) and redirecting said flow through apertures (84, 84*a*, 84*b*, 84*c*) in the wall of said sleeve (8) to said nozzles (6).

The apertures (84) are linked by a circumferential ring groove so as for allowing flow to said nozzles (6) independent of the exact orientation of the central sleeve (8), please see FIGS. 3 and 4.

Phrased in another way, the invention is a magnetic retrieval tool using curl flow forming angled flow ports, in a ported generally non-magnetic housing with the set of magnets and a ball drop operated flow control sleeve for flow diversion to remove accumulated debris from the borehole. This invention allows several related operations to be conducted with the same tool: debris cleaning, magnetic debris removal and wellbore cleaning operations, all generally in the same run.

In an embodiment the curl flow forming nozzles have a diameter of 14 mm and the diameter of the ridge (7*b*) portion is about 165 mm. The diameter of the set of magnets (3), preferably the Halbach set of magnets (3, 31, 32, 33, 34, 35) is 125 mm. A larger diameter unit may have proportionally larger dimensions, with ϕ=20 mm flow forming nozzles.

In an embodiment of the invention shown in FIG. 9, said flow control sleeve (8) is initially arranged in an upper position in said central channel (4) and locked by shear pins (83) in said upper housing (2*b*) arranged for breaking at a desired pressure or vertical force when said ball (82) closes said closing seat (81).

In an advantageous embodiment the curl flow forming nozzles (6) are arranged in a nozzle-bearing wall (7*bw*), please see FIG. 2 and FIGS. 5, 6, and 7, of said ridges (7*b*), said curl flow forming nozzles (6) having a circumferential direction component in a common rotation direction common with an upward leading flow direction along said helical grooves and wings (7*a*, 7*b*).

In an advantageous embodiment, please see FIGS. 3, and 4, one or more of said apertures (84, 84*a*, 84*b*, 84*c*) in the wall of said sleeve (8) are arranged in levels (L1, L2, L3) of said sleeve (8) so as for joining up with one or more of said nozzles (6) when said sleeve (8) is displaced to its lower position, for opening the flow to said nozzles (6), so as for opening fully for the curl forming flow when the ball kicks in.

In an embodiment of the invention, please see FIG. 2, one or more of said apertures (84, 84*a*, 84*b*, 84*c*) in the wall of said sleeve (8) are arranged in levels of said sleeve (8) so as for not joining up with one or more of said nozzles (6) when said sleeve (8) is in its upper position. This is for keeping closed one or more of nozzles (6) before the ball is dropped in place in its seat.

In the embodiment shown in FIG. 2, one or more of said apertures (84, 84-L) in the wall of said sleeve (8) is arranged in levels of said sleeve (8) so as for joining up with at least one of said nozzles (6) when said sleeve (8) is in its upper position, so as for maintaining a restricted curl forming flow before the ball kicks in. Here is shown apertures 84-L in the lower part of sleeve (8) which allow flow to the lower set of nozzles (6*a*) when the sleeve is in its upper position. This maintains a desired low flow of fluid before the ball is dropped, presumably before the magnet, preferably configured as a Halbach set of magnets, has fished an object.

Figure 5:
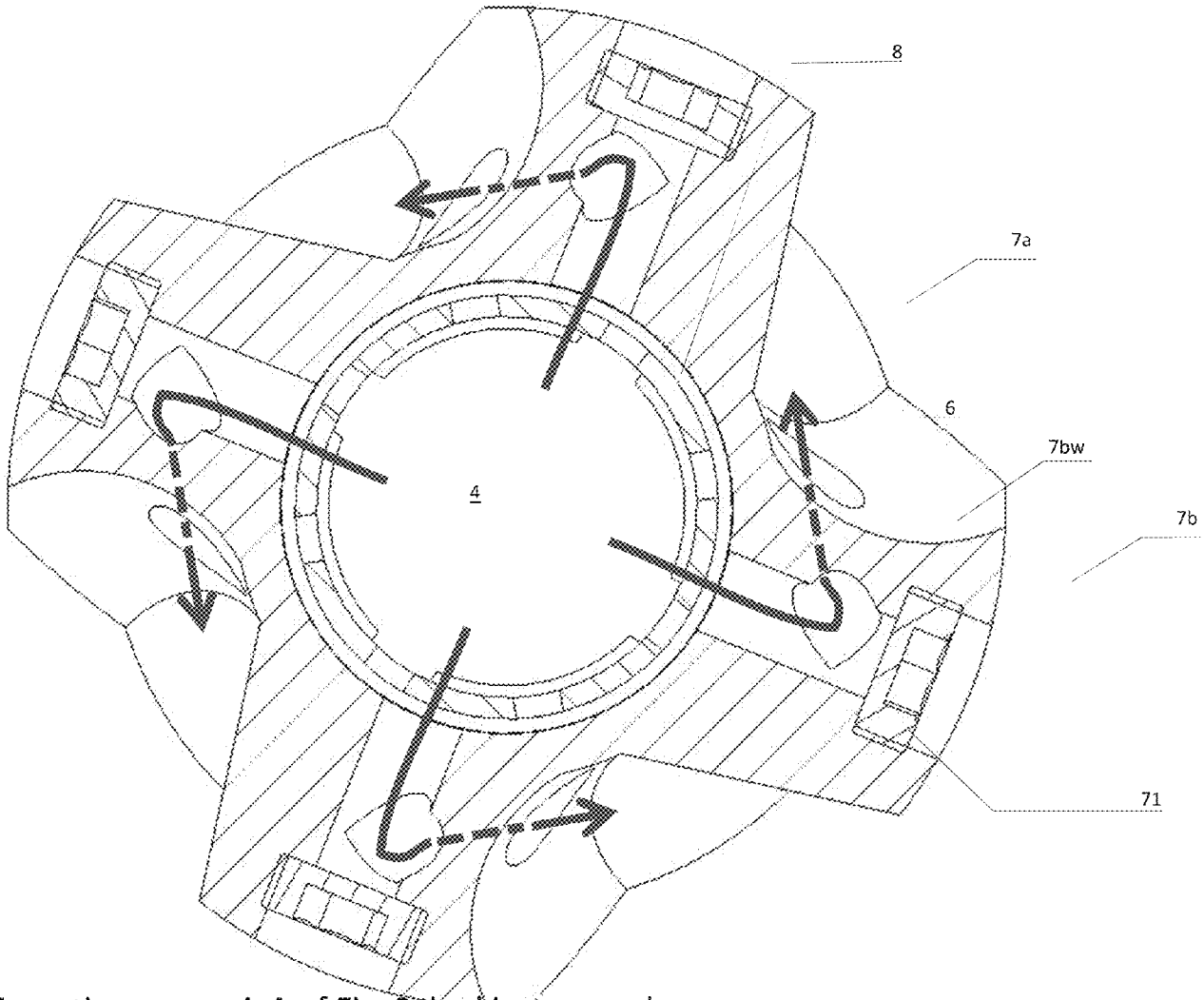
Figure 6:
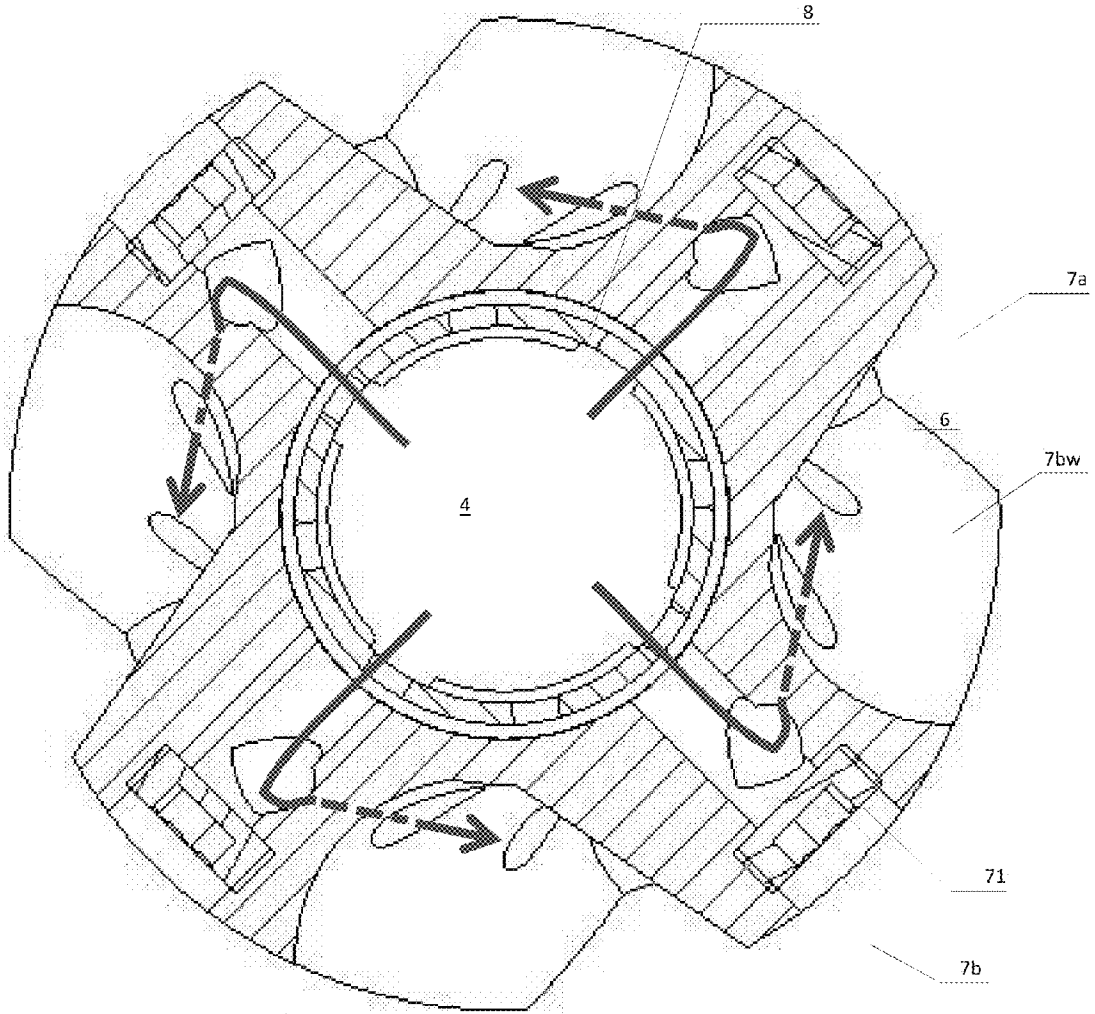
FIG. 6 is similar to FIG. 5, but the cross-section is at a lower level, here level L1 of flow control sleeve 8, through B-B of FIG. 2. Both
Figure 7:
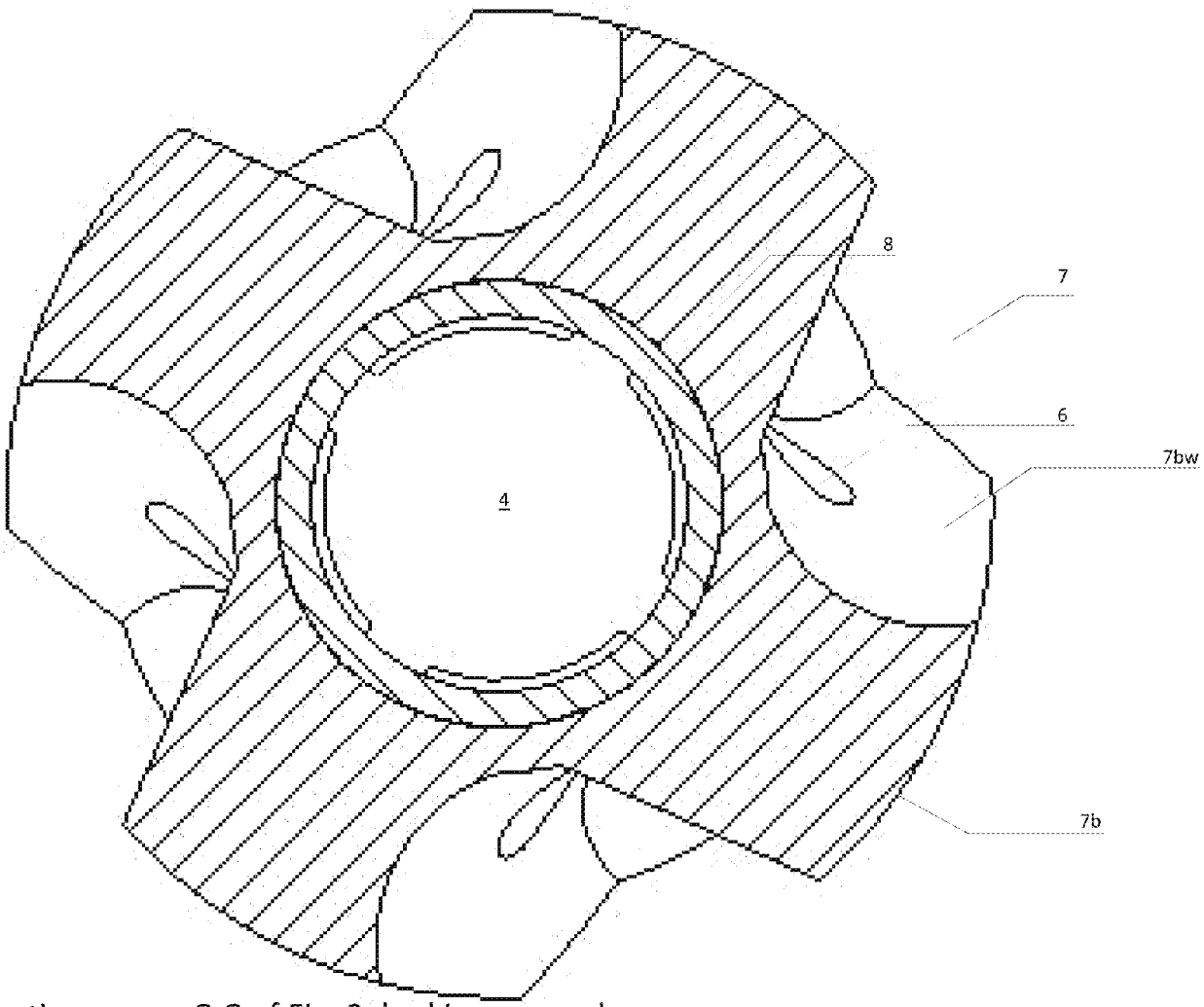
FIG. 7 is similar to FIGS. 5 and 6, but is a cross-section through a solid portion of the ridge 7*b*, through C-C of FIG. 2.

In a preferred embodiment of the invention said curl flow forming nozzles (6) have an upward direction component, please see FIGS. 4, 5, and 6.

In an embodiment of the invention shown in FIGS. 1, 2 and 10, said lower cylindrical housing (2*a*) is provided with axially parallel external grooves (5*g*) between corresponding external ridges (5*r*), said ridges (5*r*) comprising said peripherally arranged internal peripheral nose ports (5*b*).

Each of said curl flow forming nozzles (6) are formed through a side face (7*bw*) of said external ridge (7*b*), said curl flow forming nozzle (6) leading into a radial channel (61) in said external ridge (7*b*), said radial channel (61) drilled radially through said external ridge (7*b*) to said central channel (4) and plugged outside said curl flow forming nozzle (6) by a plug (71), please see FIG. 5.

Advantageously, said Halbach magnet (3, 31, 32, 33, 34, 35) is formed from a high flux alloy such as Neodymium steel. As shown in FIG. 10, said set of magnets (3, 31, 32, 33, 34, 35) is formed from one central magnet and four surrounding magnets. In an embodiment of the invention said set of magnets' central magnet (31) is polarized with its north pole pointing downwards, and said surrounding magnets (32, 33, 34, 35) are polarized with their north pole pointing radially inwards towards said central magnet (31), please see FIG. 10. This set of magnets may be called a Halbach set of magnets. Other, more finely subdivided sets of Halbach magnets are envisioned. In the shown embodiment the central magnet may be a rectangular prism and magnetized vertically, while the four surrounding magnets are magnetized horizontally, so as for setting up an axial vertical field in the center of the lower face 3*f* which has its return flux to the sides of this axial vertical field. This will concentrate the magnetic flux in the vertical direction and increase the holding capacity of the lower face (3*f*) of the Halbach magnet compared to single permanent magnets which have an ordinarily distributed magnetic flux which is equal at the top and the bottom surface, if magnetized vertically.

The Halbach magnet is a multiple-domain magnetized cylinder composed of five pieces of ferromagnetic material producing an intense magnetic field mainly confined within the cylinder's lower face and with low magnetic field intensities at the lateral cylinder surface and possibly the upper surface facing inwards in the tool housing. The Halbach cylinder is contained by epoxy inside a nonmagnetic housing closed off with a lid and held in place by four bolts on the nonmagnetic housing. Said nonmagnetic housing 2*a* contains the flow ports 5*b* for fluid distribution.

Low magnetic field on the outer cylindrical housing surface. Low magnetic field on top of magnet cylinder. Intense magnetic field on bottom of magnet cylinder.

The present invention's combination of a Halbach magnet and a nonmagnetic housing with flow ports creates a more powerful magnetic field through one downward-facing surface 3*b* which is the lower surface of the tool. The intense magnetic field at the lower surface of the tool is utilized to attract magnetic fragments, steel debris and missing parts that are undesired to have in a wellbore (see illustration 1.).

The described set of magnets (3, 31, 32, 33, 34, 35) is utilized to obtain the following:

Intense magnetic field through bottom surface of the magnetic cylinder will catch and hold magnetic objects on said magnetic cylinder bottom surface. With the nose flow nozzles (5*b*) the surface will be cleaner than with the prior art, and the catching and holding capacity in practice will significantly increase.

The intense magnetic field through the bottom surface will prevent metallic debris to collect on other surfaces of the tool of the invention comprising the non-magnetic housing may be placed on a mandrel, i.e. a shaft or spindle on which the non-magnetic housing may be held, for rotation or not in the wellbore. The non-magnetic lower housing's 2*a* main purpose is to hold the magnet in place. Advantageously, when the Halbach magnet is in place, the Halbach set of magnets is fixedly held and sealed in the epoxy-lined cavity. Preferably the epoxy seal constitutes a water and pressure tight housing for the magnet to prevent the magnet from corroding and falling out of the housing. The nose flow ports are made to transport fluid from center of the lower part of the curl flow forming body and down outside the magnet element. This allows the fluid to wash the objects left in the well free from mud, clay or other substance that can prevent the magnet from catching and collecting the magnetic object. This is a significant advantage over the prior art. The tool's upper and lower housing, as well as other parts of the tool housing (except for the steel ball) will be generally non-magnetic (i.e. low-permeability).

The fact that the tool housing including the curl flow forming body is generally non-magnetic (of low magnetic permeability) prevents the magnetic field from the Halbach magnet to propagate and thus spread and induce a magnetic field in the flow sleeve and curl flow forming body that could result in magnetic debris buildup inside the tool, and thus plug up the hole tool and cause circulation problems.

The curl flow forming body of the upper housing 2*b* receives fluid under pressure through the drilling string or coiled tubing. It has angled flow nozzles releasing and initiating a powerful cyclone of drilling fluid. As the fluid has only one way out, upwards, its flow creates an effective lift force on any debris.

The mandrel may in the shown embodiment be provided with a flow control sleeve 8 inside its central cylindrical cavity 4. The flow sleeve is for controlling the fluid distribution and is displaceably operated by a steel ball dropped into the flow.

The flow sleeve has equal distribution ports for balanced fluid distribution before the steel ball releases the flow control sleeve.

In operation the wellbore fluid is equally distributed thru the nose ports of the flow ported non-magnetic housing and the curl flow forming ports by the lower flow control distribution ports of the sleeve 8. By dropping the ball and shifting the flow sleeve downwards the entry to the ported non-magnetic housing nose ports about the Halbach magnet are blocked and wellbore fluid is distributed through said curl flow forming ports for well bore cleaning combining curl flow well cleaning and removal of magnetic debris. When the nose ports are closed the downward flushing force on the magnetic object held on the Halbach magnet ceases. However, the Halbach magnet is so strong so the nose flow will have little negative effect when a single object is held on the magnet, but it will prevent a large amorphous magnetic mass from being gradually flushed off the magnet. The most important contribution of closing the nose flow is to redistribute the flow volume to the curl flow after having caught the magnetic object.

In the embodiment shown in FIG. 10, which shows a cross-section and upward view of the lower portion (2*a*) and shows the array of the Halbach magnet 3 in its cylindrical sleeve with channeled ridges with the nose ports 5. Please notice that the periphery of ridges (7*b*) is continuous.

The invention claimed is:

1. A petroleum well drill string or coiled tubing string mounted fishing tool, comprising:

a main body comprising a lower housing with a magnet having at least one magnet surface facing downwards in said well at a lower end of said lower housing and arranged for catching and holding undesired magnetic objects present in said well, said main body provided with a connector to said drill string or coiled tubing string at its upper end, wherein said main body further comprising a generally cylindrical upper housing with a central channel with laterally directed curl flow forming nozzles through the cylindrical wall of said upper housing, said nozzles leading out into one or more helical grooves between helical ridges, said curl flow forming nozzles being arranged in a nozzle-bearing wall of said ridges, said curl flow forming nozzles having a circumferential direction component in a common rotation direction common with an upward leading flow direction along said helical grooves and wings, said magnet comprising permanent magnets arranged in a magnetization pattern which concentrates their combined magnetic flux through said downwards facing surface, said upper housing's vertical channel extending near its lower end to peripherally directed channels extending to an outer wall of said lower housing about said magnets and leading to axially directed peripheral nose ports at a peripheral lower end of said lower housing and arranged for flushing fluid ahead of said magnet, and said central channel provided with a vertically displaceable cylindrical flow control sleeve which is provided with a closing seat near its lower end so as for receiving a ball for shutting off the flow to said nose ports and redirecting said flow through apertures in the wall of said sleeve to said curl flow forming nozzles.

2. The fishing tool of claim 1, wherein said flow control sleeve is initially arranged in an upper position in said central channel and locked by shear pins in said upper housing arranged for breaking at a desired pressure or vertical force when said ball closes said closing seat.

3. The fishing tool of claim 2, wherein one or more of said apertures in the wall of said sleeve are arranged in levels of said sleeve so as for joining up with one or more of said nozzles when said sleeve is displaced to its lower position, for opening the flow to said nozzles.

4. The fishing tool of claim 2, wherein one or more of said apertures in the wall of said sleeve are arranged in levels of said sleeve so as for not joining up with one or more of said nozzles when said sleeve is in its upper position.

5. The fishing tool of claim 2, wherein one or more of said apertures in the wall of said sleeve arranged in levels of said sleeve so as for joining up with at least one of said nozzles when said sleeve is in its upper position.

6. The fishing tool of claim 1, wherein one or more of said apertures in the wall of said sleeve are arranged in levels of said sleeve so as for joining up with one or more of said nozzles when said sleeve is displaced to its lower position, for opening the flow to said nozzles.

7. The fishing tool of claim 6, wherein one or more of said apertures in the wall of said sleeve are arranged in levels of said sleeve so as for not joining up with one or more of said nozzles when said sleeve is in its upper position.

8. The fishing tool of claim 1, wherein one or more of said apertures in the wall of said sleeve are arranged in levels of said sleeve so as for not joining up with one or more of said nozzles when said sleeve is in its upper position.

9. The fishing tool of claim 1, wherein one or more of said apertures in the wall of said sleeve arranged in levels of said sleeve so as for joining up with at least one of said nozzles when said sleeve is in its upper position.

10. The fishing tool of claim 1, wherein said curl flow forming nozzles have an upward direction component.

11. The fishing tool of claim 10, wherein each of said curl flow forming nozzles are formed through a side face of said external ridge, said curl flow forming nozzle leading into a radial channel in said external ridge, said radial channel drilled radially through said external ridge to said central channel and plugged outside said curl flow forming nozzle by a plug.

12. The fishing tool of claim 1, wherein said lower cylindrical housing is provided with axially parallel external grooves between corresponding external ridges, said ridges comprising said peripherally arranged internal peripheral nose ports.

13. The fishing tool of any of claim 1, wherein said magnet is formed from Neodymium steel.

14. The fishing tool of claim 1, wherein said magnet is formed from one central magnet and four surrounding magnets.

15. The fishing tool of claim 14, wherein said magnet is a Halbach set of magnets, and a central magnet of said Halbach set of magnets is polarized with its north pole pointing downwards, and said surrounding magnets are polarized with their north pole pointing radially inwards towards said central magnet.

16. The fishing tool of claim 1, said lower housing and said upper housing comprise low-magnetic permeability material.

* * * * *